US006123032A

United States Patent [19]

Ohanesian

[11] Patent Number: 6,123,032

[45] Date of Patent: Sep. 26, 2000

[54] THERMOPLASTIC PALLET

[76] Inventor: Harout Ohanesian, 9 Tattersail La., Laguna Niguel, Calif. 92677

[21] Appl. No.: 09/168,304

[22] Filed: Oct. 7, 1998

[51] Int. Cl.[7] ..... B65D 19/38

[52] U.S. Cl. ..... 108/57.26; 108/57.28; 108/901

[58] Field of Search ..... 108/57.25, 57.26, 108/57.28, 57.29, 57.1, 901

[56] References Cited

U.S. PATENT DOCUMENTS

| | | | |
|---|---|---|---|
| 3,467,032 | 9/1969 | Rowlands et al. . | |
| 3,524,415 | 8/1970 | Heiman . | |
| 3,610,173 | 10/1971 | McIlwraith et al. . | |
| 3,707,127 | 12/1972 | Palfey . | |
| 3,719,157 | 3/1973 | Arcocha et al. . | |
| 3,750,596 | 8/1973 | Box . | |
| 3,776,145 | 12/1973 | Anderson et al. . | |
| 3,880,092 | 4/1975 | Seeber et al. | 108/901 X |
| 4,015,544 | 4/1977 | Szatkowski . | |
| 4,290,369 | 9/1981 | Propst et al. . | |
| 4,887,537 | 12/1989 | Kellogg | 108/55.3 X |
| 5,404,829 | 4/1995 | Shuert | 108/901 X |
| 5,413,052 | 5/1995 | Breezer et al. | 108/57.25 X |
| 5,483,899 | 1/1996 | Christie | 108/901 X |
| 5,596,933 | 1/1997 | Knight et al. | 108/901 X |
| 5,845,588 | 12/1998 | Gronnevik | 108/907 X |
| 5,868,080 | 2/1999 | Wyler et al. | 108/901 X |

*Primary Examiner*—Peter M. Cuomo
*Assistant Examiner*—Hanh V. Tran
*Attorney, Agent, or Firm*—Myers, Dawes & Andras

[57] ABSTRACT

An improved load bearing pallet formed of a thermoplastic material is provided. The pallet includes at least an upper deck formed from a sheet of thermoplastic material with a load engaging surface on one side of the sheet, and a lift engaging surface on the other. A number of features such as ridges, channels, depressions, and legs, are formed in the sheet with corresponding features being necessarily defined by the sheet on the opposite side. In particular, the pallet preferably includes a peripheral channel formed around a periphery of the upper deck and nine legs positioned in three rows of three creating two gaps on each side of the pallet for the tines of a fork lift to enter to lift the pallet. The pallet also preferably includes a plurality of strengthening ridges and channels on the load bearing surface of the upper deck, with corresponding channels and ridges necessarily formed in the lifting surface of the upper deck, to resist bending and folding of the pallet. The pallet may further include at least one reinforcing member received within the peripheral channel. The reinforcing member preferably includes a steel core encapsulated within a thermoplastic coating that is molecularly bonded or cross-linked to the molecular structure of the thermoplastic material of the pallet. The pallet may additionally include a lower deck or other support structure, preferably molecularly bonded to the upper deck. The lower deck may also include ridges, channels, depressions, legs, and reinforcing members as desired.

19 Claims, 5 Drawing Sheets

110
130
128
114
134
132
110
100
2
2

112
104
112
108
108
120
114
100
102

118
124
122
120
116
114

THERMOPLASTIC PALLET

FIELD OF THE INVENTION

The present invention relates generally to pallets and shipping trays, and more particularly to improved load bearing pallets and shipping trays comprising thermoplastic material.

BACKGROUND OF THE INVENTION

Many wooden and plastic pallets are known in the art. However, pre-existing wooden and plastic pallets are characterized by a number of disadvantages. Wooden pallets are relatively heavy and difficult to manufacture. Typical construction of such pallets utilize a first set of parallel boards forming an upper surface, and a second set of parallel boards forming a lower surface, nailed to three or more stringers positioned perpendicular to the length of the boards, and sandwiched between the upper and lower surfaces. The stringers used to separate the upper and lower deck surfaces create two openings to accommodate the arms of a forklift for lifting and moving the pallets. The wood used to construct the pallets may swell and warp if exposed to moisture. Wooden pallets are subject to rotting and splintering, and the wood may be a substrate for the growth of fungus and bacteria, especially under moist conditions. The nails used in the pallets may rust, and sometimes causes cargo damage or injuries.

Attempts to form pallets from other materials in order to avoid the disadvantages inherent in wooden pallets have been only partially successful. Prior art designs using plastics to form pallets have been characterized by a trade off between cost and weight bearing capability. Those pallets having a significant weight bearing capability tend to be heavy and expensive, whereas plastic pallets produced inexpensively typically have reduced durability and weight bearing capacity.

What is needed is a pallet design comprising a plastic material that overcomes the disadvantages of the prior art. Specifically, it is desirable to provide a pallet that is inexpensive and relatively light weight yet strong, that is formed of recyclable materials, that is stackable, that may be readily assembled on site, that may be picked up by a fork lift from all four sides, that is resistant to the growth of fungus and bacteria, and that is easily cleaned.

SUMMARY OF THE INVENTION

Accordingly, the invention is an improved load bearing pallet including at least an upper deck formed of a sheet of rigid but formable material, such as plastic or metal but preferably a thermoplastic material, with a load engaging surface on one side of the sheet and a lift engaging surface on the other. A number of features such as ridges, channels, depressions, and legs are formed in the sheet with corresponding features being defined by the sheet on the opposite side. The pallet preferably includes a peripheral channel formed around a periphery of the upper deck and nine legs positioned in three rows of three creating two gaps on each side of the pallet for the tines of a fork lift to enter to lift the pallet.

In a second embodiment, the pallet may further include at least one integral reinforcing member received within the peripheral channel. Preferably one reinforcing member is positioned within the peripheral channel on each side of the pallet, but in alternate embodiments, a unitary ring that fits around the pallet, but within the peripheral channel, may be used. The reinforcing members may be formed of any desired materials, including metal or wood. However, the reinforcing members preferably comprise a steel support structure encapsulated within a thermoplastic material. The reinforcing members are preferably bonded within the channel of the upper deck by causing the molecular structure of the thermoplastic material encapsulating the support structure to cross-link with the thermoplastic material comprising the upper deck to integrally bond the reinforcing member to the upper deck to form a unitary object.

In other embodiments, the pallet may further include a lower deck or other support structure. The lower deck is preferably formed of a single sheet of rigid but formable material, preferably a thermoplastic material, comprising a top surface and a bottom surface. A plurality of legs are formed in the top surface of the lower deck, corresponding to an equal number of legs extending from the lifting surface of the upper deck. Each leg formed in this way in the lower deck is coupled to a corresponding leg of the upper deck. The bond between the legs of the lower deck and the legs of the upper deck are preferably made by causing the molecular structure of the thermoplastic material of the upper deck to cross link to the molecular structure of the lower deck, although in alternate embodiments, other means for coupling the upper and lower decks may be used.

The lower deck may further include a plurality of channels and ridges formed in the top surface of the lower deck, which correspond to channels and ridges formed in the bottom surface. The lower deck may additionally include a plurality of reinforcing members, each preferably comprising a steel support structure encapsulated within a thermoplastic coating, although other materials may be used in alternate embodiments. The reinforcing member is received within the peripheral channel of the lower deck and is preferably bonded therein by causing the molecular structure of the thermoplastic material encapsulating the support structure to cross link with the molecular structure of the thermoplastic material of the lower deck.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DETAILED DESCRIPTION

The following description is provided to enable any person skilled in the art to make and use the invention and sets forth the best modes contemplated by the inventors of carrying out their invention. Various modifications, however, will remain readily apparent to those skilled in the art, as the generic principles of the present invention have been defined herein for providing an improved pallet.

The pallet of the invention includes at least an upper deck formed of a sheet of rigid but formable material, such as plastic or metal, with a load engaging surface on one side of the sheet, and a lift engaging surface on the other. A number of features such as ridges and legs are formed in the sheet with corresponding features being defined by the sheet on the opposite side. In other embodiments, the pallet may further include a lower deck or other support structure, and may further include integral reinforcing members. A detailed description of several exemplary embodiments of the invention will now be made with reference to the figures listed above and wherein like features are identified by like numbers.

Figures 1, 2, 3:
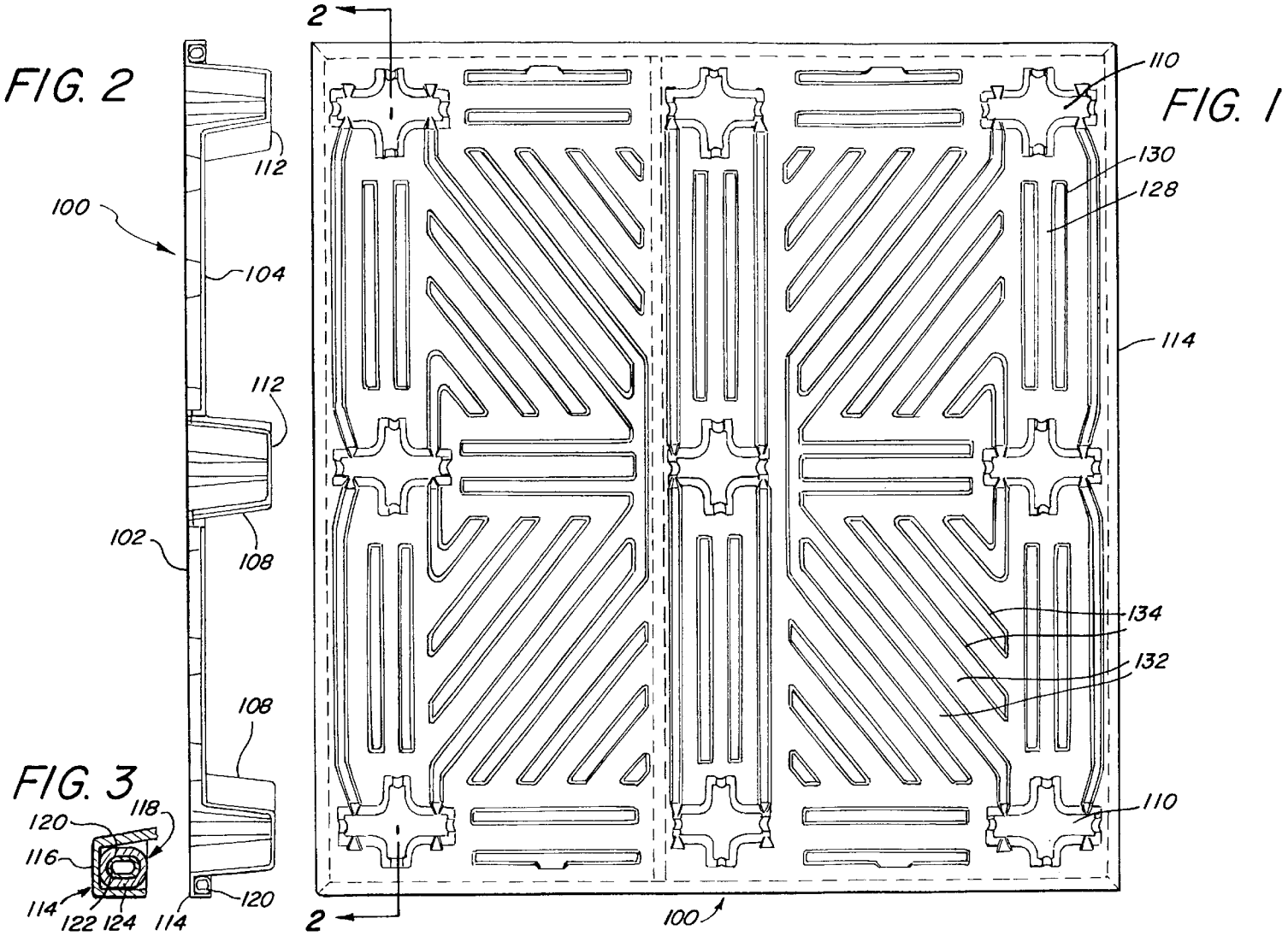
FIG. 1 is a top plan view of a pallet of a first embodiment of the invention comprising a single deck pallet.
FIG. 2 is a cross-sectional side view of the pallet of FIG. 1 taken along line 2—2.
FIG. 3 is a magnified view of a reinforcing member of the pallet of FIG. 2 positioned within a peripheral channel.

Referring now to FIG. 1, a first embodiment of the pallet of the invention is shown generally referenced by the number 100. The pallet 100 is preferably fabricated from a single sheet, and comprises an approximately planar upper deck 102, with an upper load bearing surface 104 and on the opposite side a lower lifting surface 106. The upper deck 102 is preferably substantially rectangular, and is of a standard pallet size, typically 1200 to 1300 mm in length and 800 to 1,000 mm in width, although the pallet 100 may be made in any useful or desired size or shape. There are preferably nine legs 108, best seen in FIG. 2, formed in three rows of three, thereby forming two gaps between the legs 108 on each side of the pallet 100. However, in alternate embodiments, more or less than nine legs 108 may be used. The size of the gaps will depend on the size and length of the legs 108. These gaps allow the tines of a forklift to enter under the upper deck 102 from any side to engage the lifting surface 106 to lift the pallet 100.

The pallet 100 is preferably formed of a High Density Polyethylene (HDPE) compound, of a suitable relatively constant thickness. However, in alternate embodiments, any useful or practical material may be used, including any desired plastics and plastic alloys or metal sheets, such as aluminum. In embodiments using HDPE, the thickness and density of the sheet material used to fabricate the pallet 100 may be varied depending on the load requirements for which the pallet 100 is intended and the strength characteristics of the materials used in constructing the pallet 100. It is preferable that the thickness of the sheet material used to fabricate the pallet 100 range between 5 and 10 millimeters, and more preferably between 6 and 8 millimeters, depending on whether a light or heavy-duty pallet is required. The density of the HDPE material comprising the sheet is preferably between 1.15 and 1.20 grams per cubic centimeter, and most preferably approximately 1.18 grams per cubic centimeter.

It is a particular advantage of the pallet of the invention that the materials used in fabrication can be chosen for custom uses, for example, the sheet material may be selected for resistance to damage in cold environments or exposure to selected chemicals, such as detergents, acids, alkalis, salts, and sea water, or ultra violet sunlight. Furthermore, thermoplastic materials such as HDPE can be readily fabricated in a variety of custom colors, and the colors can be used to color code the materials loaded on the pallets for easy identification.

A number of features, including ridges, channels, and depressions, are formed in the sheet material of the upper deck 102. In all embodiments described herein, features or configurations on one side of the sheet will have corresponding features or configurations on the opposite side. For example, a ridge formed in the top or load bearing surface 104 of the upper deck 102 defines a corresponding channel in the bottom or lifting surface 106 of the upper deck 102. Referring again to FIG. 1, a plurality of tapered leg depressions 1 0 in the upper load bearing surface 104 correspond to a plurality of legs 108 extending downward from the lifting surface 106. The leg depression 110 and corresponding legs 108 preferably extend to a flat end, and are preferably of the same length so that the weight of the pallet 100 is evenly distributed among the legs 108. The legs 108 preferably extend sufficiently beyond the depth of other features on the lower lifting surface 106 of the upper deck 102 so that gaps between adjacent legs 108 are sufficient to allow the tines of a forklift to enter under upper deck 102 to raise or move the pallet 100. The leg depressions 110 and corresponding legs 108 may be any desired or practical shape such as circular, oval, triangular or quadrilateral in cross-section. However, in the embodiment seen in FIG. 1, three leg depressions 110 are cross-shape in cross-section. All of the leg depressions 110 are preferably tapered so that the area of the bottom of each leg depression 110 is smaller than the area of the opening at the top of the leg depression 110. Thus, the legs 108 decrease in cross section as the distance from the lower lifting surface 106 increases. The preferred angle of taper is between 4 and 8 degrees from vertical, and more preferably between 5 and 6 degrees from vertical. The taper of the legs 108 facilitates space saving nesting of the pallets when stored.

The pallet 100 is surrounded by a peripheral flange 114 defining a ridge 116 on the periphery of the upper load bearing surface 104, and a corresponding channel 118 on the lower lift bearing surface. The geometry of the peripheral flange 114 is preferably chosen to inhibit bending, flexing or buckling of the upper deck 102 at the periphery of the pallet 100. As shown in FIG. 2 and magnified in FIG. 3 the peripheral channel 118 is substantially U-shaped, and, therefore, unsealed. In FIGS. 2 and 3, the peripheral channel 118 has an opening along a bottom side of the upper deck 102 that allows a reinforcing member 120 to be received in the peripheral channel 118 via the opening. In the embodiment seen in FIG. 1, a reinforcing member 120 is received within the peripheral channel 118 of the peripheral flange 114 to add additional strength. The reinforcing member 120 may be any practical material, however, the preferred configuration of the reinforcing member 120 is a steel structural member 122 encapsulated in a thermoplastic material 124. Encapsulation of the steel structural member has the advantage of protecting the steel structural member form corrosive forces. The reinforcing member 120 may be a unitary ring dimensioned to be received within the peripheral channel 118, or more preferably four separate elongate reinforcing members, with one elongate member positioned within the peripheral channel 118 on each side of the pallet 100. The encapsulating thermoplastic material 124 of the reinforcing member 120 is preferably fully compatible with the material used in the manufacture of the upper deck 102 so that the reinforcing member 120 may be heat welded or fused to the upper deck 102 within the peripheral channel 118 to form a unitary object. The definition of the word "fuse" is intended to include a process whereby a molecular structure of one part is cross-linked to a molecular structure of another part. In alternate embodiments, the reinforcing member 120 may be coupled within the peripheral channel 118 using an adhesive. The steel structural member 122 of the reinforcing member 120 is preferably a steel bar that is oval in cross section, although other desired shapes may be used. The reinforcing member 120 is preferably positioned within the peripheral channel 118 with a long axis of the oval approximately perpendicular to the plane of the load bearing surface 104 of the upper deck 102.

A plurality of ridges are defined by depressions and channels in the load bearing surface 104 of the upper deck 102. As previously explained, corresponding features exist on the lifting surface 106 of the upper deck 102. The ridges and channels are preferably arranged to provide additional resistance to bending, flexing or buckling of the upper deck 102. A preferred arrangement of the ridges and channels is seen in FIG. 1, which shows a plurality of channels 128 and ridges 130 extending between adjacent leg depressions 110. Thus, the upper load bearing surface 104 is divided into four squares. Within each square, a plurality of ridges 132 and channels 134 radiate diagonally from the center leg depression 110 towards a corner leg depression 110. The ridges, and corresponding channels, preferably have a tapered cross section and a flat top. The angle of taper is preferably between 6 and 8 degrees from vertical, and more preferably approximately 8 degrees from vertical. The tops of the ridges 128, 132 define a plane, just as the tops of the ridges on the lower lifting surface 106 of the upper deck 102 define a parallel plane. The height of the ridges 128, 132 measured relative to the depth of an adjacent channels 130, 134 is preferably between 25 and 32 millimeters, and more preferably between 28 and 30 millimeters. The depth of a channels measured from an adjacent ridge will be correspondingly the same.

The configuration of the ridges and channels, together with the manner in which the legs 108 are constructed, allow the pallet 100 to achieve a very high strength without a significant increase in the amount of material used to construct the pallet 100. The configuration of channels and ridges shown in FIG. 1 is intended to increase stability and load bearing strength of pallet 100 without creating areas of weakness susceptible to structural failure. In alternate embodiments, alternate configurations of ridges and channels may be used. For example, the number and orientation of ridges used can vary greatly, and in alternate embodiments the ridges may be V or U shaped in cross section.

The ridges 128 and 132 may act to prevent movement of a load on the pallet 100. However, in an alternate embodiment, an anti-slip or friction coating may be added to the load bearing surface 104. The friction coating may be painted onto the load bearing surface 104, or laminated or otherwise adhesively affixed onto the load bearing surface 104. If laminated, the friction coating or film may preferably be added by co-extrusion of the film and the sheet material used to fabricate the upper deck 102. In a further alternate embodiment, a texture may be formed in the load bearing surface 104 during the vacuum molding process.

The pallet 100 is particularly well adapted for self-draining. The configuration of the channels 130 and 134 may be modified to provide a continuous draining channel by creating communication between the channels 130 and 134 and the leg depressions 110. Thus if the pallet 100 is used to for moving or storage of liquid containers or agricultural materials, fluids that leak form the containers or agricultural materials may be directed toward the leg depressions 110. In some embodiments, apertures may be further provided in the leg depressions 110 to allow the fluids to drain from the pallet 100.

The pallet 100 of the invention is particularly constructed so as to be readily manufacturable through a vacuum thermoforming process, wherein the sheet of formable material is heated and vacuum formed against a mold to produce the desired pallet configuration. In construction, the sheet material used to manufacture the pallet 100 of the invention is mounted onto a thermoform vacuum mold. The thermoform vacuum mold is preferably a one sided mold having vacuum ports to draw the sheet material against the mold, with the sheet material being heated so as to generally conform to the shape of the mold. In embodiments including reinforcing members 120, the reinforcing member 120 is pressed into the peripheral channel 118 under pressure while the sheet and/or encapsulating coating 124 encapsulating the structural member 122 is in a semi-molten state so that they fuse forming unitary object.

Figure 4:
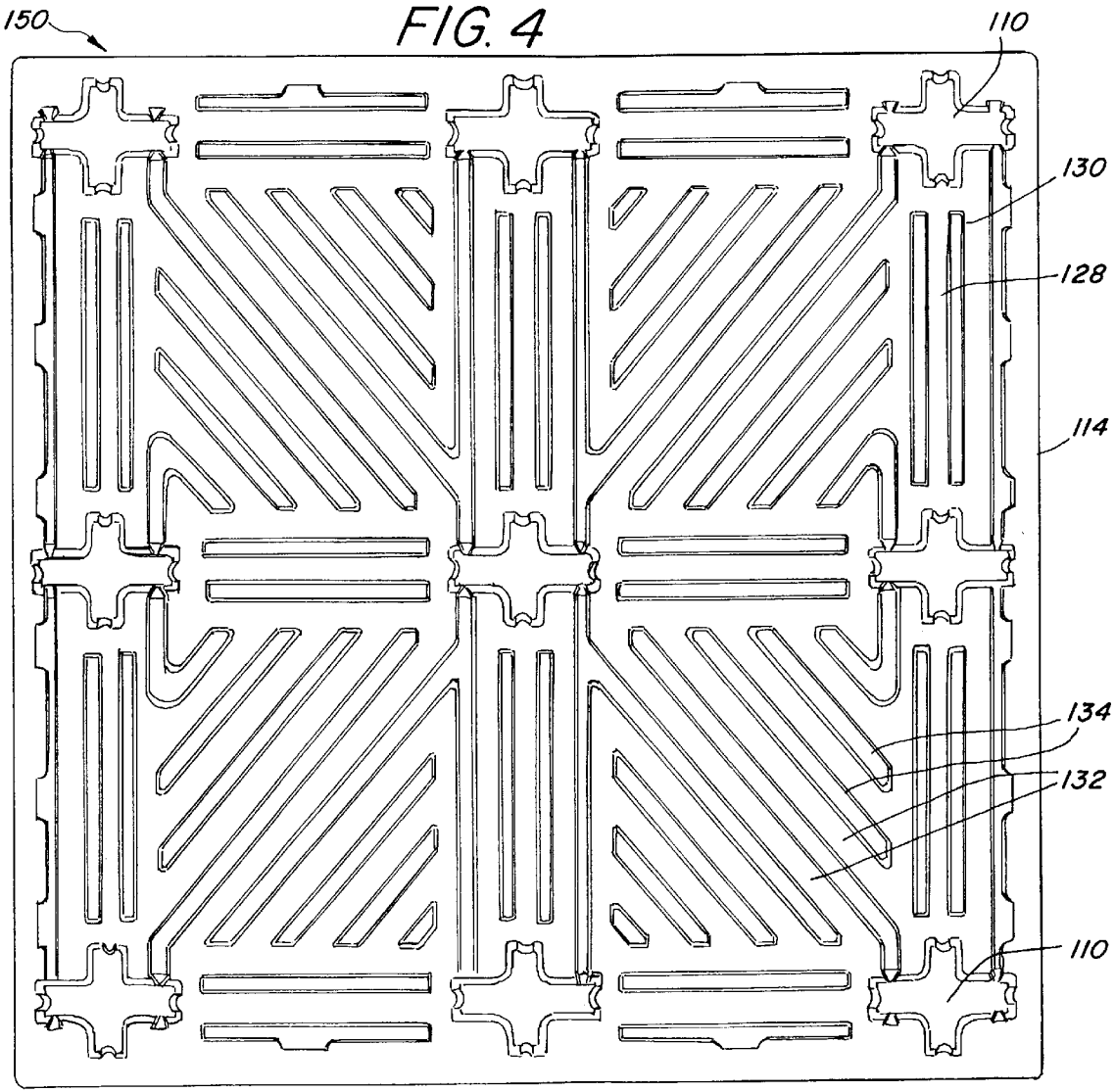
FIG. 4 is a top view of a second embodiment of the invention comprising a dual deck pallet.
Figure 5:
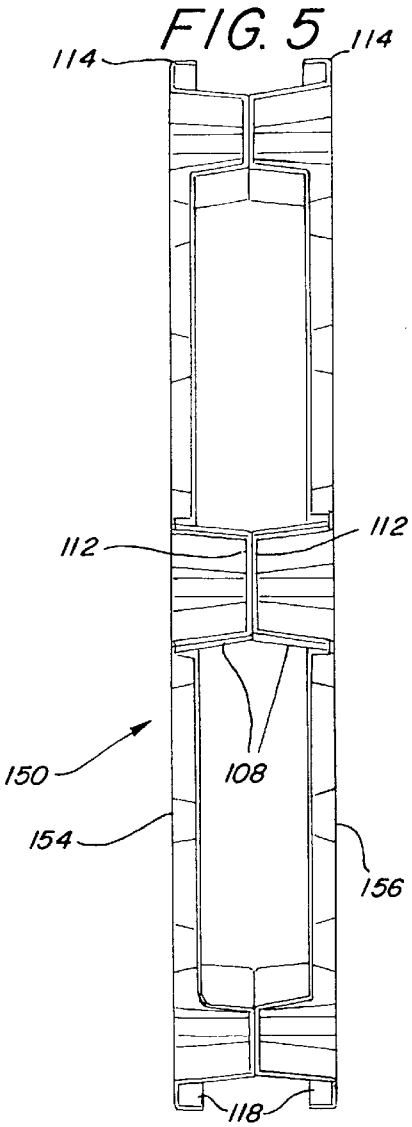
FIG. 5 is a cross-sectional side view of the pallet of FIG. 4 taken along line 5—5.

FIGS. 4 and 5 illustrate a double deck embodiment of the pallet of the invention. In this embodiment, two identical deck portions are joined at the flat ends 112 of the legs 108 to form the pallet 150 having an upper deck 154 and an identical lower deck 156. The use of a lower deck 156 increases the stability of the pallet 150 when stacked or placed on an uneven surface. The upper and lower decks 154, 156 are preferably joined at the legs 108 by heat welding, however, adhesives or mechanical coupling means such as metal or plastic rivets or bolts may be equally useable. The configuration of ridges and channels shown in FIG. 4 is somewhat different than that shown in FIG. 1. However, the configuration and fabrication of the upper deck 154 of the pallet 150 is otherwise the same as that discussed in relation to the upper deck 102 of the pallet 100 of FIG. 1.

FIG. 5 shows a cross-sectional view of the pallet 100 of FIG. 4 taken along line 5-5. No reinforcing members are used in this pallet 100, however, reinforcing members could easily be added by fusing the reinforcing members into the peripheral channel 118 as previously described in the pallet of FIG. 1.

Figure 8:
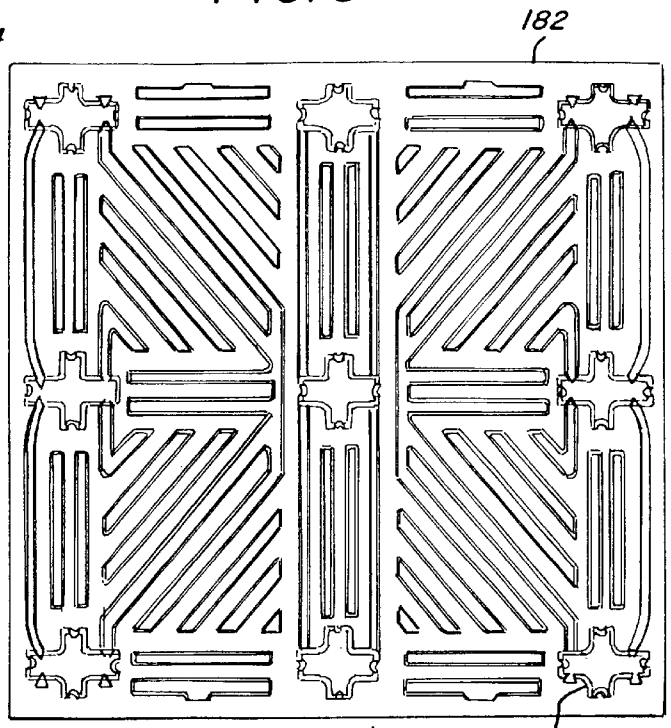
FIG. 8 is a top plan view of the upper deck of the pallet of FIG. 6.
Figure 7:
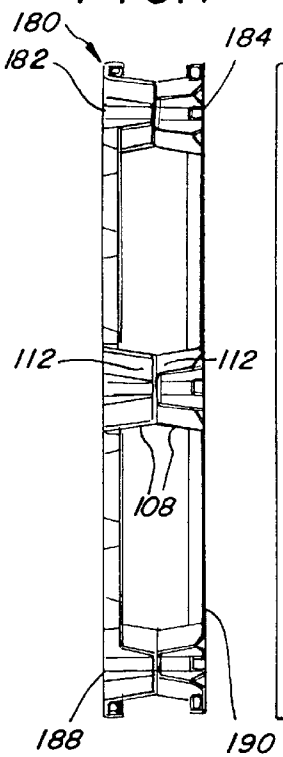
FIG. 7 is a cross-sectional side view of the pallet of FIG. 6 taken along line 7—7.
Figure 6:
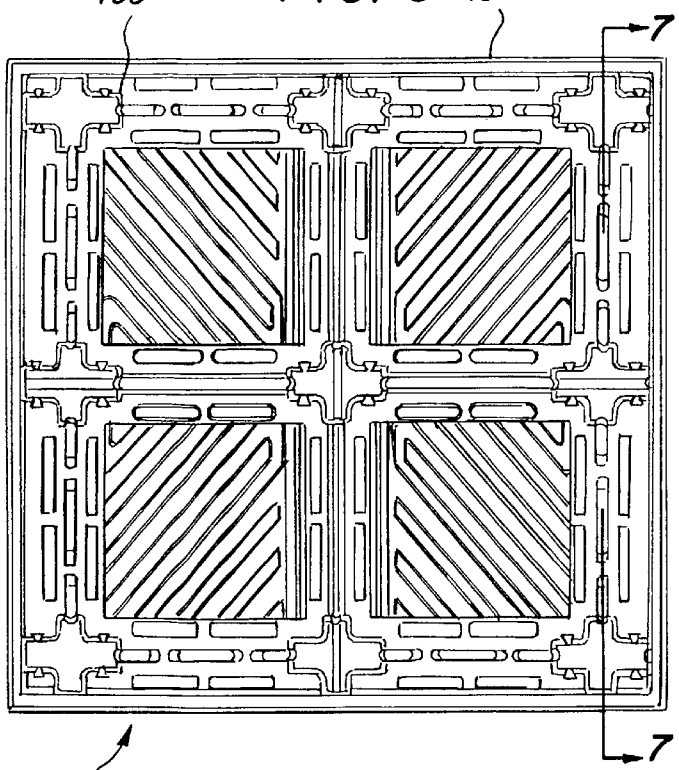
FIG. 6 is a bottom plan view of a third embodiment of the invention comprising a dual deck pallet.

FIGS. 6, 7, and 8 show bottom, cross-sectional, and top views, respectively, of a double deck embodiment of the pallet 180 wherein the load bearing surface 188 of the upper deck 182, seen in FIG. 8, and the bottom surface 190 of the lower deck 184, seen in FIG. 6, are not configured identically. In this embodiment, the lower deck 184 can be specialized or customized to provide maximum strength and stability when used for specialized stacking or storing purposes. In the embodiment shown, both the upper deck 182 and the lower deck 184 include a reinforcing member, best seen in FIGS. 7, 9, and 10. FIG. 7 shows a cross-sectional view of FIG. 6 taken along line 7—7. The upper deck 182 and the lower deck 184 can be seen joined at the ends 112 of the legs 108. As in previous embodiments, the legs of the upper deck 182 and the lower deck 184 are preferably joined by fusing the material from which the upper and lower decks 182, 184 are fabricated at the point of contact.

Figure 9:
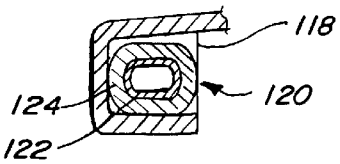
FIG. 9 is a magnified view of the reinforcing member of the pallet of FIG. 6 positioned within the peripheral channel of the upper deck.

FIG. 9 shows a magnified view of the reinforcing member 120 within the peripheral channel 118 of the upper deck 182.

The configuration of the peripheral channel 118 and the reinforcing member 120 of the upper deck 182 is similar to that previously described relating to the upper deck 102 of FIG. 1, wherein the reinforcing member comprises a structural member 122, preferably a steel bar, having an oval cross section, encased within a thermoplastic coating 124, disposed within the peripheral channel 118 with the long axis of the oval being approximately perpendicular to the plane of the upper deck 182.

Figure 10:
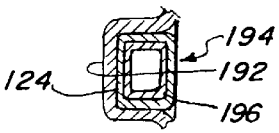
FIG. 10 is a magnified view of the reinforcing member of the pallet of FIG. 6 positioned within the peripheral channel of the lower deck.

However, the configuration of the peripheral channel 192 and the reinforcing member 194 of the lower deck 184 is different than the configuration the peripheral channel 118 and reinforcing member 120 of the upper deck 182. FIG. 10, shows a magnified cross-sectional view of the reinforcing member 194 of the lower deck 184 of the pallet 180 of FIG. 8. The peripheral channel 192 of the lower deck 184 opens toward the bottom surface 190 of the lower deck 184. The reinforcing member 194, received within the peripheral channel 192 of the lower deck 184, is preferably comprised of a structural member 196, preferably a steel bar, that is square in cross-section and encased within thermoplastic material 124. The flat edge of the reinforcing member 194 provides a stable base for the pallet 180.

In alternate embodiments of two deck pallets, the lower deck may not include legs 108, and may instead have depressions or other structures to receive the legs 108 from the upper deck 102. In this embodiment, the legs 108 of the upper deck 102 would preferably be lengthened to maintain an appropriate gap for entry of the tines of a forklift.

Figure 11:
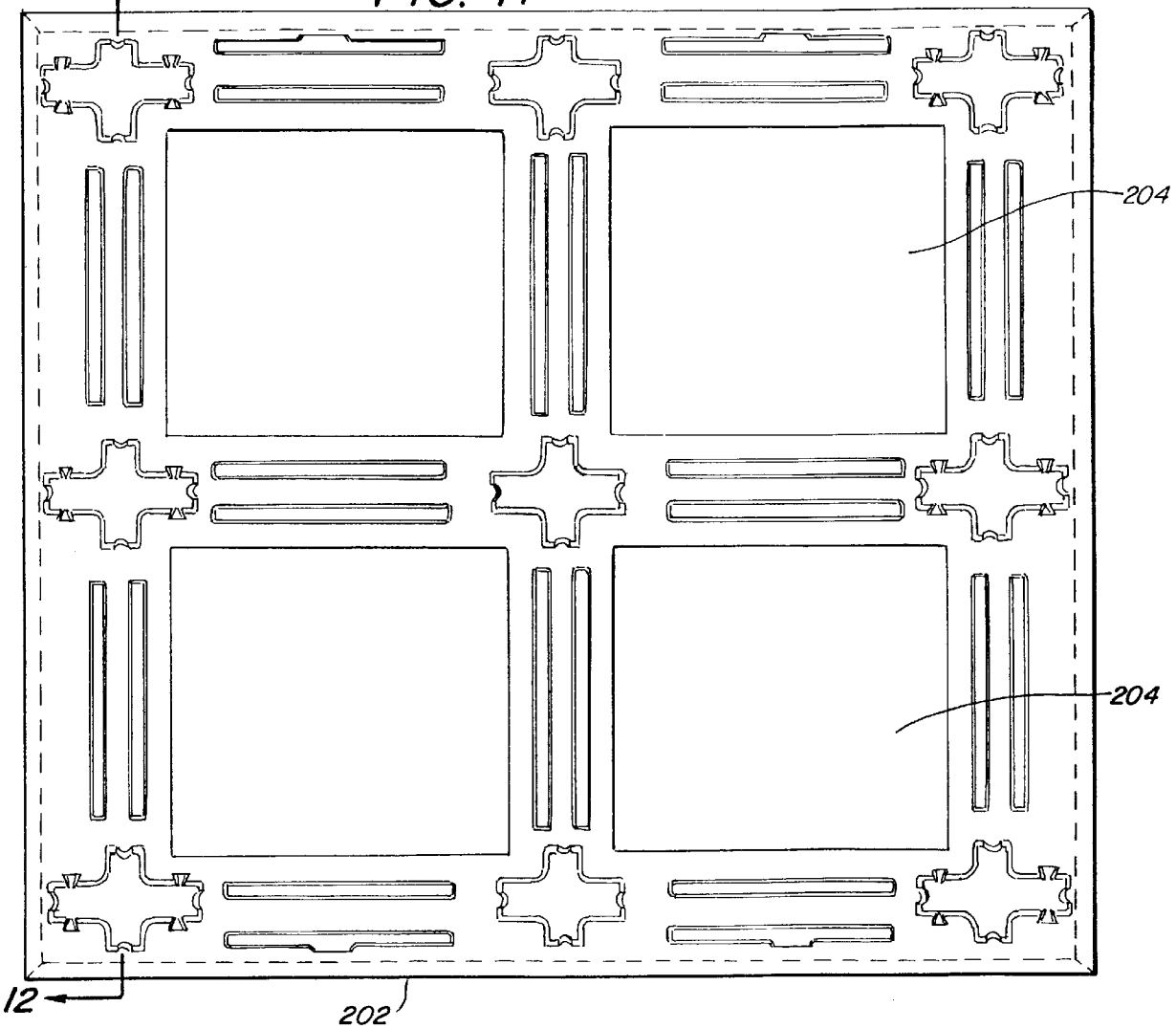
FIG. 11 is a bottom plan view of the lower deck.
Figure 12:
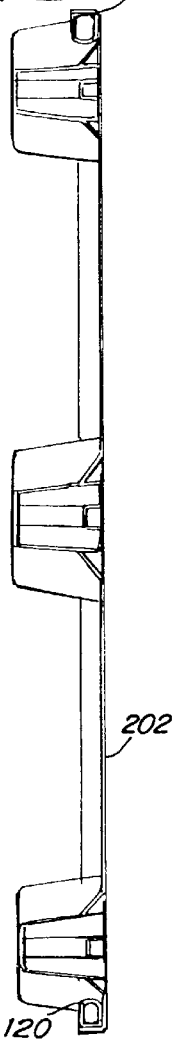
FIG. 12 is a cross sectional view of the pallet of FIG. 11 taken along line 12—12.

FIGS. 11 and 12 show an alternate embodiment of a two deck pallet 200 wherein the lower deck 202 includes open areas 204. FIG. 11 shows a plan view of the bottom surface 206 of the lower deck 202. The open areas 204 are provided so that less material is used in the fabrication of the lower deck 202, resulting in a lighter and less expensive pallet configuration. The open area 204 also allows the pallet to be used with a "pallet jack" as well as a fork lift truck. In this case, the front wheels of the pallet jack work through the open areas. A slope on the deck edge allows easy access for the pallet jack to enter. FIG. 12 shows a cross-sectional view of the pallet 200 of FIG. 11 along line 12—12. In the embodiment shown, the configuration of the reinforcing members 120 in both the upper and lower decks is the same. However, in alternate embodiments, the reinforcing members 120 need not be included. The construction and fabrication of the pallet 200 of FIGS. 11 and 12 are otherwise the same as that described in earlier embodiments.

Figure 13:
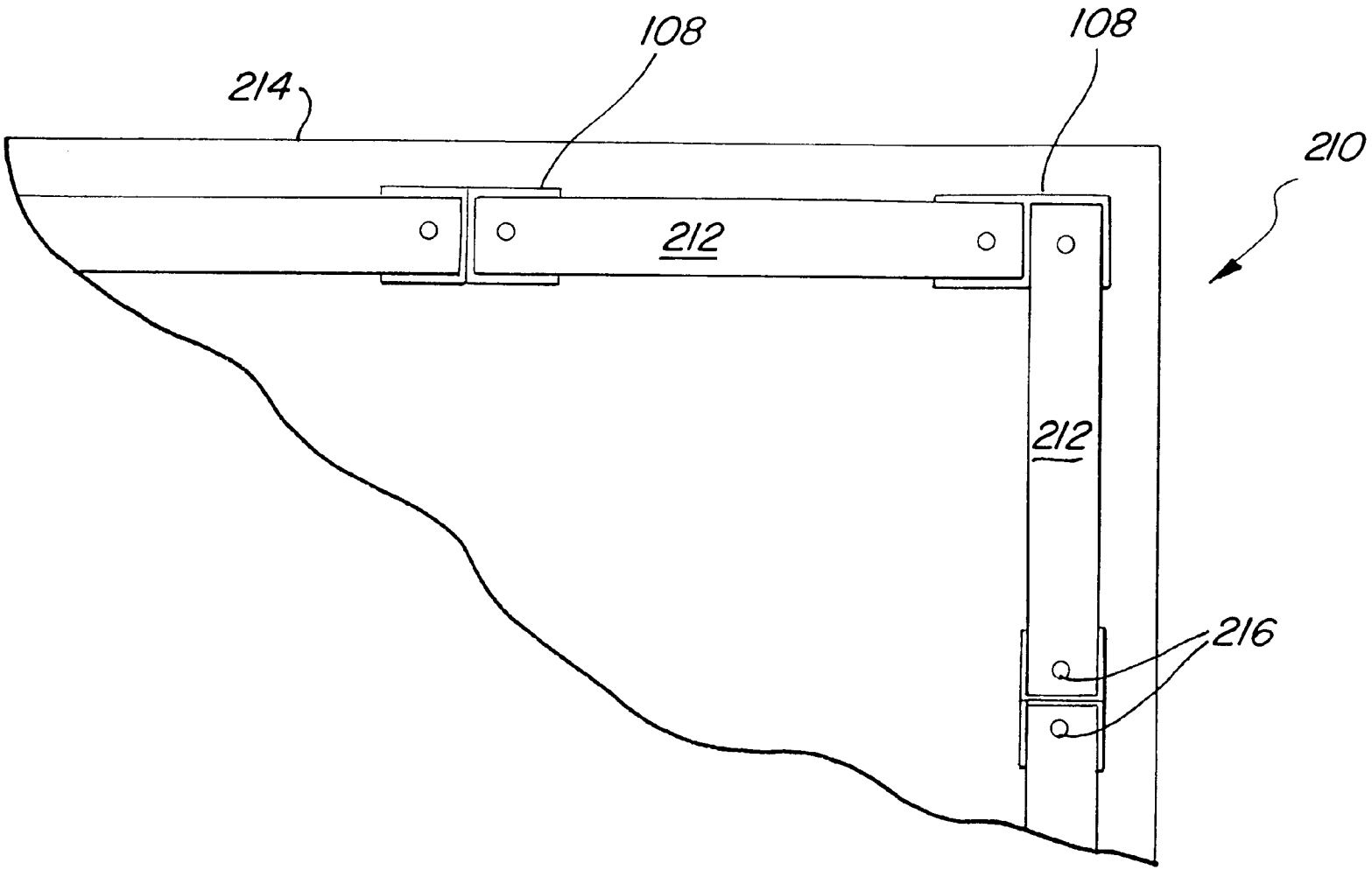
FIG. 13 is a bottom plan view of a portion of the lifting surface of a fourth embodiment of the invention comprising a single deck pallet with wooden runners coupled between adjacent legs.

FIG. 13 shows a bottom plan view of a single deck pallet embodiment 210 having wooden runners 212 coupled to the bottoms 112 of legs 108 of the upper deck 214 of the pallet 210 using plastic rivets 216, although any other known means for coupling the runners may be used, including adhesives, staples, nails, and screws.

In operation, the pallet in all embodiments described above functions to provide an economical, efficient, and extremely strong pallet formed of thermoplastic material. Reinforcing members can be added to the pallet to further increase the strength of the pallet without excessively increasing the weight of the pallet. The pallet is, thus, durable and can withstand long term use. Additional advantages of the pallets described above include the following: (1) the pallets are reversible in some configurations, (2) the weight of material used to manufacture the pallets is less than conventional wooden pallets, (3) the lower deck design of some pallet embodiments ensures even weight distribution, (4) many embodiments of the pallets comprise a single structural body rather than a plurality of parts coupled together, thus presenting a strong unitary pallet, (5) the pallets are fabricated of recyclable materials, and (6) the pallets can be provided in a kit form that is easily stored and moved in the disassembled state, and that is readily assembled at a desired location. In the disassembled state the upper and/or lower decks may be easily stored in nested stacks, thus minimizing the volume of space required to store the unused pallets.

When used for storing or moving objects that may be upset by the ridges and channels on the load bearing surface of the pallets, such as relatively small objects, a plastic, ply wood, or metal sheet may be placed on the load bearing surface between the upper deck and the load on the pallet to present a flat surface. In alternate embodiments, the load bearing surface may include ridges, depressions, or other structures designed for securely locating or holding materials on the pallet. For example, the pallet may include one or more raised projections to be received within a hollow core of spooled materials to be stored or moved on the pallet.

Pallets constructed in accordance with this description have been found to support loads ranging from 750 kg to more than 1.5 metric tons dynamic load, and 2 metric tons to more than 6 metric tons static load, depending on the configuration of the pallet and whether reinforcing members are used. The pallets have been observed to have a typical useful life more than 10 times the life of standard wooden pallets.

Although the present invention has been described in terms of the presently preferred embodiments, it is to be understood that such disclosure is not to be interpreted as limiting. Various alterations and modifications will no doubt become apparent to those skilled in the art after reading the above disclosure. Accordingly, it is intended that the appended claims be interpreted as covering all alterations and modifications as fall within the true spirit and scope of the invention.

What is claimed is:

1. A pallet comprising:

an upper deck formed from a single sheet of rigid but formable material, the single sheet of rigid but formable material having a load bearing surface on a first side of said sheet, and a lifting surface on an opposite second side of said sheet, a plurality of depressions in said load bearing surface corresponding to an equal number of legs extending from said lifting surface, a plurality of channels and ridges formed in said single sheet to form a plurality of channels and ridges in said load bearing surface and a corresponding plurality of ridges and channels in said lifting surface wherein each said ridge in said load bearing surface corresponds to a channel formed in said lifting surface and each said channel formed in said load bearing surface corresponds to a ridge formed in said lifting surface, and an inverted peripheral substantially U-shaped channel formed around and opening from a periphery of said upper deck; and at least one reinforcing member received within said peripheral substantially U-shaped channel through the open side of said inverted peripheral substantially U-shaped channel.

2. The pallet of claim 1 wherein said plurality of depressions equals nine depressions disposed in three rows of three depressions forming gaps to accept the tines of a fork lift, whereby a forklift may be used to lift the pallet.

3. The pallet of claim 1 wherein said pallet comprises a thermoplastic material.

4. The pallet of claim 3 wherein said reinforcing member comprises a structural member encapsulated within a thermoplastic material.

5. The pallet of claim 4 wherein a molecular structure of the encapsulating thermoplastic material is caused to cross-link with a molecular structure of said thermoplastic material comprising the upper deck to integrally bond said support structure to said upper deck.

6. The pallet of claim 1, further comprising a lower deck.

7. The pallet of claim 6, wherein said lower deck is formed of a single sheet of rigid but formable material comprising a top surface and a bottom surface.

8. The pallet of claim 7, wherein a plurality of depressions equal to the number of depression in said upper deck are formed in said bottom surface, corresponding to an equal number of legs extending from said top surface of said lower deck, and wherein each said leg of said lower deck is coupled to a corresponding leg of said upper deck.

9. The pallet of claim 8 wherein each said leg of said upper deck is coupled to a corresponding leg of said lower deck by causing a molecular structure of said thermoplastic material of said upper deck in contact with said leg of said lower deck to cross-link to a molecular structure of said leg of said lower deck.

10. The pallet of claim 7 further comprising a plurality of channels and ridges formed in said top surface of said lower deck, wherein each said ridge in said top surface corresponds to a channel formed in said bottom surface and each said channel formed in said top surface corresponds to a ridge formed in said bottom surface.

11. The pallet of claim 7 further comprising a peripheral channel formed around a periphery of said lower deck.

12. The pallet of claim 11 further comprising at least one reinforcing member received within said peripheral channel of said lower deck.

13. The pallet of claim 12 wherein said reinforcing member comprises a structural member encapsulated within a thermoplastic material, and wherein a molecular structure of the encapsulating thermoplastic material is caused to cross-link with a molecular structure of said thermoplastic material comprising the lower deck to integrally bond said support structure to said lower deck.

14. A pallet comprising:

an upper deck formed from a first sheet of thermoplastic material, said upper deck having a load bearing surface on a first side of said first sheet, and a lifting surface on an opposite second side of said first sheet, a plurality of depressions in said load bearing surface corresponding to an equal number of legs extending from said lifting surface, a plurality of channels and ridges formed in said load bearing surface wherein each said ridge in said load bearing surface corresponds to a channel formed in said lifting surface and each said channel formed in said load bearing surface corresponds to a ridge formed in said lifting surface, and an inverted peripheral substantially U-shaped channel formed around a periphery of said upper deck, and at least one reinforcing member received within said peripheral substantially U-shaped channel through the open side of said inverted peripheral substantially U-shaped channel; and a lower deck formed from a second sheet of thermoplastic material, said lower deck having a first top surface, and an opposite second bottom surface, a plurality of depressions in said bottom surface corresponding to an equal number of legs extending from said top surface, the number of legs being equal to the number of legs in said upper deck, a plurality of channels and ridges formed in said top surface wherein each said ridge in said top surface corresponds to a channel formed in said bottom surface and each said channel formed in said top surface corresponds to a ridge formed in said bottom surface, and a peripheral substantially U-shaped channel formed around a periphery of said lower deck, wherein each said leg of said upper deck is coupled to a corresponding leg of said lower deck.

15. The pallet of claim 14, wherein each said leg of said upper deck is coupled to said corresponding leg of said lower deck by causing a molecular structure of said thermoplastic material of said leg of said upper deck in contact with said leg of said lower deck to cross-link to a molecular structure of said leg of said lower deck.

16. The pallet of claim 14 wherein said reinforcing member comprises a structural member encapsulated within a thermoplastic material, and wherein a molecular structure of the encapsulating thermoplastic material is caused to cross-link with a molecular structure of said thermoplastic material comprising the upper deck to integrally bond said support structure to said upper deck.

17. The pallet of claim 14 further comprising at least one reinforcing member received within said peripheral channel of said lower deck.

18. The pallet of claim 17 wherein said reinforcing member comprises a support structure encapsulated within a thermoplastic material, and wherein a molecular structure of the encapsulating thermoplastic material is caused to cross-link with a molecular structure of said thermoplastic material comprising the upper deck to integrally bond said support structure to said lower deck.

19. The pallet of claim 14 further comprising at least one reinforcing member received within said peripheral channel of said upper deck and at least one reinforcing member received within said peripheral channel of said lower deck.

* * * * *